US011835210B1

(12) United States Patent
Meyrath

(10) Patent No.: US 11,835,210 B1
(45) Date of Patent: Dec. 5, 2023

(54) FLASHLIGHT ELEMENT

(71) Applicant: Todd Philip Meyrath, Henderson, NV (US)

(72) Inventor: Todd Philip Meyrath, Henderson, NV (US)

( * ) Notice: Subject to any disclaimer, the term of this patent is extended or adjusted under 35 U.S.C. 154(b) by 397 days.

(21) Appl. No.: 17/026,219

(22) Filed: Sep. 19, 2020

Related U.S. Application Data

(60) Provisional application No. 62/902,404, filed on Sep. 19, 2019.

(51) Int. Cl.
*F21V 29/70* (2015.01)
*F21V 23/00* (2015.01)
*F21L 4/02* (2006.01)

(52) U.S. Cl.
CPC ..... *F21V 29/70* (2015.01); *F21L 4/022* (2013.01); *F21L 4/027* (2013.01); *F21V 23/004* (2013.01)

(58) Field of Classification Search
CPC ..... F21V 23/003–006; H05K 3/462; H05K 2201/10106; F21L 4/00–085
See application file for complete search history.

(56) References Cited

U.S. PATENT DOCUMENTS 7,153,004 B2 12/2006 Galli
7,503,671 B2 3/2009 Kang
8,573,796 B2 11/2013 Opolka
8,899,777 B2 12/2014 Uke
9,022,612 B2 5/2015 Maglica
9,332,599 B2 5/2016 Kasakura
9,349,930 B2 5/2016 Lee
9,453,624 B2 9/2016 Sharrah
9,568,154 B2 2/2017 Hansen
10,383,209 B2 8/2019 Helbig
2014/0218902 A1* 8/2014 Maglica ..... F21V 14/045 362/188
2017/0159891 A1* 6/2017 Yanwei ..... H05K 1/00

FOREIGN PATENT DOCUMENTS

CN 101749628 A * 6/2010
CN 205504563 U * 8/2016
CN 205504564 U * 8/2016
CN 205504565 U * 8/2016
CN 206514182 U * 9/2017

* cited by examiner

*Primary Examiner* — Mariceli Santiago
(74) *Attorney, Agent, or Firm* — Daniel Klemer

(57) ABSTRACT

A primary element of a flashlight is provided, incorporating the light source, driver circuitry, positive and negative battery contacts and heat sinking into a single element assembled through standard manufacturing methods on a double-sided metal core printed circuit board substrate. Heat generated by the light source and driver circuit is conducted away through the substrate and may be sunk into a flashlight housing or other mounting structure at the edge of the flashlight element or from top, bottom or both surfaces near the edge. Additional sensors and control functions may be incorporated into the driver circuit to vary the light source drive in response to changes in temperature or light source optical output.

3 Claims, 6 Drawing Sheets

FLASHLIGHT ELEMENT

CROSS-REFERENCE TO RELATED APPLICATIONS

This application claims the benefit of priority from U.S. provisional patent application No. 62/902,404, filed Sep. 19, 2019, entitled "Flashlight Element," which is herein incorporated by reference in its entirety.

FIELD

The present invention relates to flashlights, particularly portable battery-operated flashlights. It provides a primary module of a flashlight incorporating the light source, driver circuitry, positive and negative battery contacts and heat sinking into a single module which improves manufacturability, cost, and performance

BACKGROUND

Current flashlights and tactical flashlights have evolved significantly from their predecessor designs, primarily as a result of the use of semiconductor light-emitting diodes (LEDs) in place of incandescent light bulbs. LEDs exhibit a number of advantages, including significantly higher electrical-to-optical conversion efficiency, longer lifetimes, and higher immunity to shock and vibration. Furthermore, LEDs may be better suited to focusing and beam shaping.

LEDs, however, do require some sort of driver or current limiter, as light output is a function of current. And while the efficiency of LEDs is relatively high, they may still suffer approximately 40-60% conversion loss, which is transformed into heat. Moreover, as current through the LED increases, efficiency decreases as a result of droop, and as the LED junction temperature increases, its efficiency decreases as well, leading to additional losses and heating. Device lifetime may degrade appreciably as the temperature increases. Therefore, it is important to heat sink the LED light source well.

Due to the need to heat-sink the LED light source, particularly for high-power devices, A typical prior-art flashlight is designed as a connected set of separate modules wired together, with one module containing only the LED light source, and another module containing a driver. Separating the modules results in more complex requirements for the drive circuitry. Wiring modules together is a labor-intensive operation performed by hand, and wired assemblies generally require more complex handling and assembly into the final product. As a result, manufacturability, cost and performance of high-quality flashlights are often limited by design decisions driven by heating of the LED light source.

SUMMARY

The present invention overcomes the drawbacks and limitations of the prior art, addressing the need for simplicity of manufacturing, reduced production cost and improved product performance by incorporating the light source, driver circuitry, positive and negative battery contacts, and heat sinking into a single physical element.

It is common for an LED light source to be affixed to a metal-core printed circuit board (MCPCB) so that the heat generated by the LED is quickly conducted through the metal core away from the device. For such applications, the MCPCB typically has a metal base, such as aluminum or copper, with a printed circuit formed on a thin insulative layer, such as FR-4 material, affixed to one side. In prior-art designs, the printed circuit is generally single-sided so that the opposite side remains free of components, and more importantly, so that the metal core may be exposed on the opposite side, allowing the MCPCB to be thermally contacted to a larger heatsink through a highly-thermally conductive interface.

In the preferred embodiment of the present invention, a round double-sided metal-core printed circuit board (DSMCPCB) is employed as the base of the flashlight element, with the LED soldered to electrical pads on the first side of the board, a driver circuit soldered on the second side, and a spring battery contact also soldered on the second side. Electrical connections between traces on the two opposite sides of the board are established with vias that are electrically insulated from the metal core. Incorporation of the drive circuitry in the flashlight element improves the reliability and manufacturability of a flashlight that integrates the flashlight element into the design, and allows the DSMCPCB to serve as a heat sink for the circuitry, as well as for the LED light source.

Outer rings on both the first and the second side of the board form a thermal contact with the DSMCPCB and a common second battery contact. By including ring contacts on both first and second sides of the board, a mating part or parts may interface thermally and electrically with the flashlight element from either or both sides of the board. Moreover, the metal core of the DSMCPCB is exposed and accessible from the edge of the board, and additional thermal and electrical contact may be established therewith.

The flashlight element of the present invention may readily be assembled using standard automatic printed circuit assembly methods with standard pick-and-place machines configured with the proper circuit components. Because there is no hand labor involved, the cost of assembly is minimized. Furthermore, the simplicity of the self-contained flashlight element facilitates rapid assembly of the module into a product, since it is only necessary to ensure that the appropriate outer ring contact forms a solid physical connection with the corresponding contact on the mating part.

In the most basic embodiment, the LED driver supplies constant current through the LED. There are many well-known circuit designs for a constant-current driver, and many integrated circuits available implementing this functionality. For example, a buck regulator may be configured to deliver a constant current for configurations in which the voltage from the battery is greater than the voltage drop across the LED. A boost regulator may supply LED drive current in a configuration for which the battery voltage is less than the voltage drop across the LED. Both buck-boost and SEPIC regulators may operate over a voltage range spanning from less than the LED voltage drop to greater than the LED voltage drop. A flyback regulator may be employed, as well.

Having the drive circuit integrated in the same module with the LED enables incorporation of further features and improvements. For example, as the temperature of the LED rises, the amount of light produced typically decreases. In certain applications, however, it may be desirable to maintain a constant light output from the flashlight. To accomplish this objective, a light detector may be positioned on the board close to the LED such that it intercepts a small portion of the light generated, and a light feedback control circuit may be incorporated on the board to regulate the LED current so as to maintain a constant signal level from the light detector.

Similarly, a thermistor, thermocouple, thermometric IC, or other temperature measurement means may be positioned at a relevant position on the board to sense the temperature of the LED, the driver, or an average flashlight element temperature. A temperature feedback control circuit may be incorporated on the board to regulate the LED current so as to maintain the measured temperature below a predetermined safe operating limit, or to shut down the driver to protect the components in the event that the temperature becomes critical.

A microcontroller or other computing device may be incorporated on the board to provide even more advanced functions, as well. For example, if a pushbutton switch is incorporated into the flashlight design to apply power to the flashlight element, the microcontroller may be programmed to control the driver in different predetermined modes, such as flashing the light or operating in a dimmed state, in response to different button press patterns, such as single-click, double-click, and press-and-hold. Furthermore, an advanced button board comprising one or more buttons and a separate microcontroller or other computing device could communicate serial data to the flashlight element through the battery terminals to control the mode of operation of the flashlight element according to specific data sequences.

While the flashlight element of the present invention has greatest application to visible white light LED sources, it may also readily be configured to incorporate alternative color visible sources, as well as IR LEDs for applications such as night vision illuminators. The integrated aspect of the flashlight element facilitates additional alternative sources, including UV LEDs, which may be used for counterfeit currency detection, adhesive curing, bactericidal applications, and other uses. Because the flashlight element eliminates the need for wires and other connections between modules and components, as would be required in a single-sided MCPCB embodiment, applications incorporating UV LED sources would not suffer from UV degradation of flashlight components, such as the cladding of wires or adhesives.

DETAILED DESCRIPTION

Figure 1:
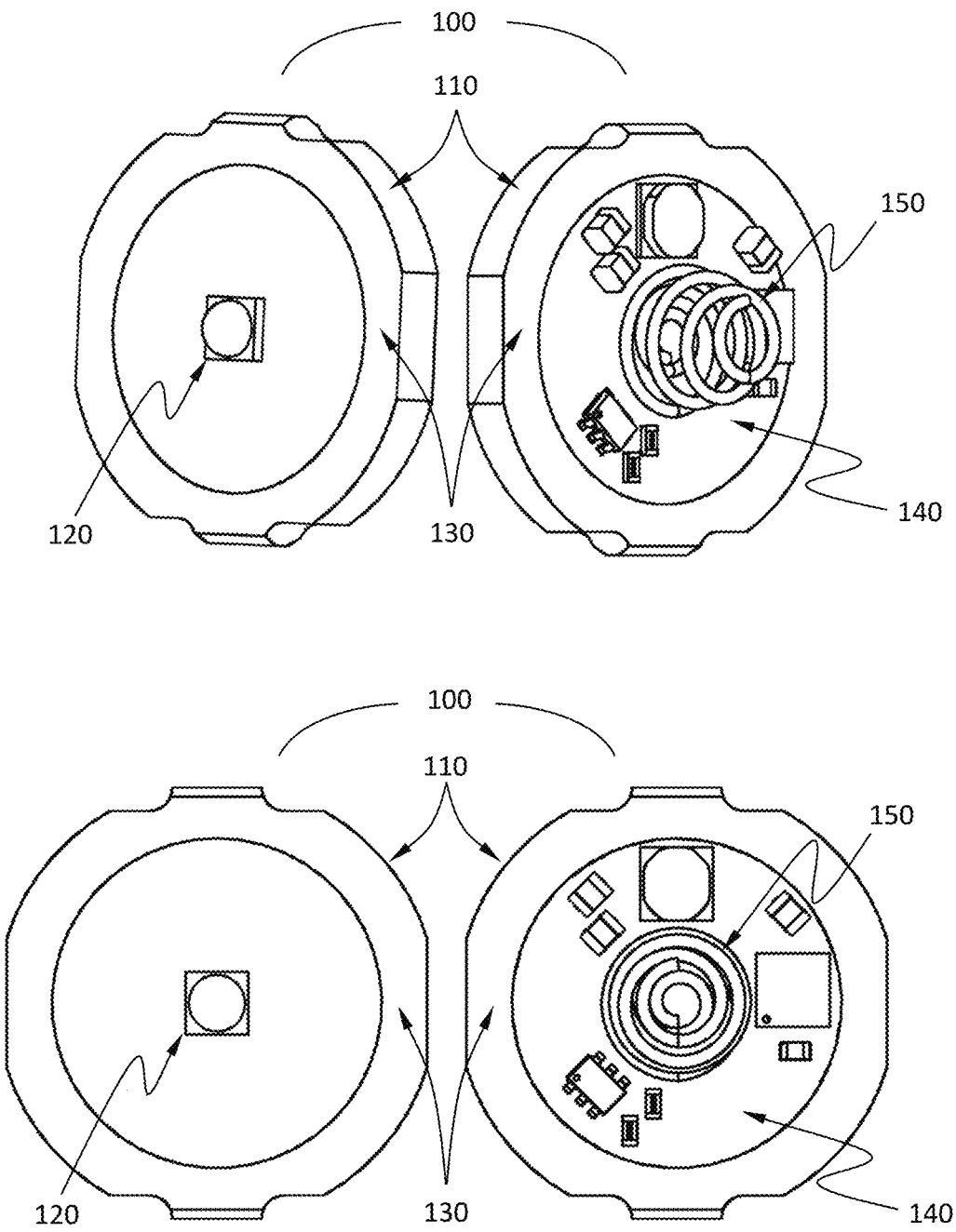
FIG. 1 shows four views (front and rear perspective views in the upper drawings and top and bottom views in the lower drawings) of the flashlight element.

The preferred embodiment 100 of the present invention is depicted in FIG. 1, showing the first and seconds sides of double-sided metal-core printed circuit board (DSMCPCB) 110. LED light source 120 is soldered to the first, or front side of DSMCPCB 110. A single LED is shown in the figure; however, alternative embodiments may incorporate multiple LEDs to produce more light or to create a broader light source. Moreover, it may be desirable to distribute multiple LEDs across the DSMCPCB so that the heat generated by the LEDs is correspondingly distributed, rather than being concentrated at a single point. Soldermask is generally used to cover, protect and electrically insulate printed circuit traces on the DSMCPCB in areas outside of component mounting pads. However, ring contact area 130 is an exposed and passivated portion of the printed circuit forming an electrical surface contact that functions as a first battery contact. It additionally serves as a thermal contact to conduct heat generated by the flashlight element into a mating part, thereby reducing the module temperature. Vias may be placed in this area to make thermal contact with the metal core for more efficient conduction of heat through this interface, as well, provided that the metal core is designed to be at the same electrical potential as ring area 130. Driver circuitry 140 is soldered to the second, or back side of DSMCPCB 110, and provides current control and other functions for appropriately driving the LED. The second battery contact is provided by spring contact 150, which is soldered to the second side of the DSMCPCB. The spring contact provides a flexible mechanical/electrical contact to the batteries to retain contact in variable thermal and mechanical conditions.

All components necessary for interfacing with a battery or other power source, providing heat sinking and thermal conduction, and driving the light source are included in flashlight element 100, and may be populated on DSMCPCB 110 using standard automated pick-and-place equipment and processes, including spring contact 150. Assembling the flashlight element using standard printed circuit board (PCB) technology results in improved reliability of production in comparison to prior-art modules requiring hand assembly and multi-step processes. Moreover, use of standard PCB fabrication equipment eliminates the need for special assembly equipment, secondary operations and operations performed by hand. Furthermore, the fully self-contained nature of the flashlight element simplifies the design and implementation of a flashlight incorporating the flashlight element, since it obviates the need for wires or hand-soldering, resulting in reduced manufacturing cost, faster assembly time, and superior reliability.

Because the LED light source is incorporated directly in the Flashlight Element, any need for wires or hand soldering is thereby eliminated. Incorporation of the LED in the flashlight element provides improved performance by eliminating losses in wires that would otherwise be necessary, and improves reliability by eliminating additional solder joints, as well. Additionally, it contributes to ease of manufacturing by eliminating these secondary assembly steps.

Because the DSMCPCB is double-sided, it allows for the ring battery contact geometry to be placed on the first side, second side, or both sides. This enables various flashlight embodiments, in which a mating housing or heatsink may be designed to contact the flashlight element on its first surface, second surface or both, for the purpose of conducting heat away from the flashlight element. Additionally, since the ring contacts on the first and second surfaces are electrically connected, electrical connection to a battery or power supply may be made through the contact on the first surface, second surface, or both. Other configurations are possible, as well. For example, a heatsink or housing may contact ring area 130 on one of the sides for the purpose of transferring heat, while an electrical contact may mate with ring area 130 on the opposing side for the purpose of making an electrical connection to a power supply.

Figure 2:
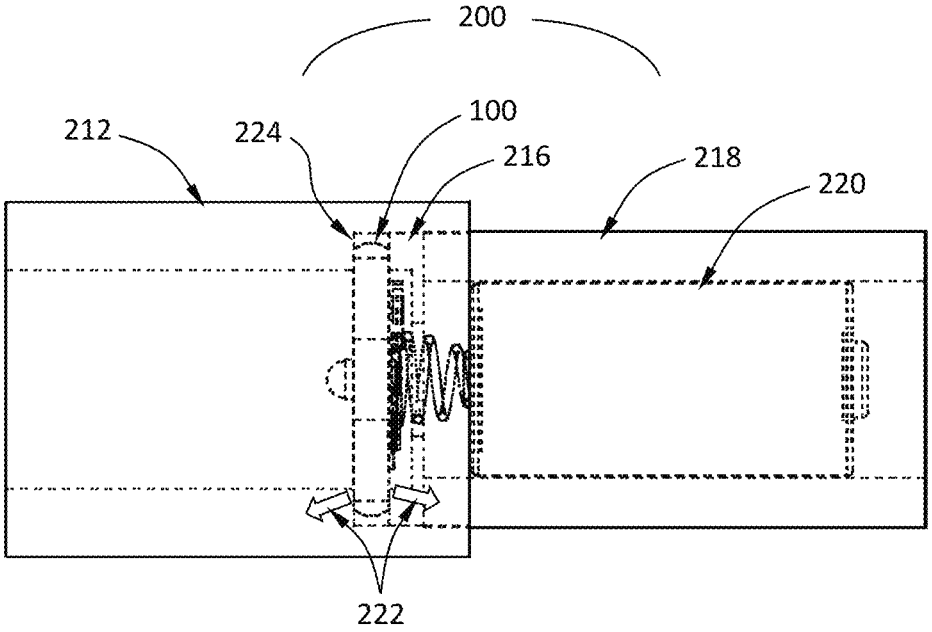
FIG. 2 shows a rear assembly view and a front assembly view for integration of the flashlight element in a flashlight; heat transfer path is indicated by arrows.
Figure 3:
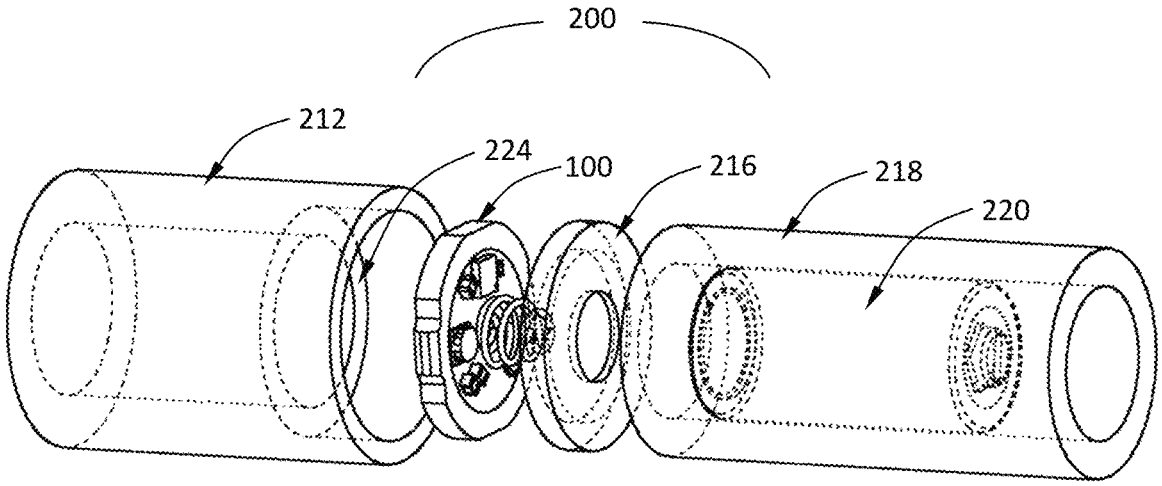
FIG. 3 is a rear exploded assembly view for implementation of a flashlight incorporating the flashlight element; this figure illustrates the simplicity of manufacturing that can be achieved with the use of the flashlight element.

In the preferred embodiment, flashlight element 100 is incorporated into flashlight assembly 200 as illustrated in FIG. 2, which shows the flashlight in its fully-assembled state, and FIG. 3, which shows an exploded view of the assembly. Because of the unique physical characteristics of the flashlight element, flashlight assembly 200 may consist of a few simple tubular structures: a first, or front tube 212 from which the light is emitted, and a second, or rear tube 218, which houses one or more batteries 220. Retaining ring 216 retains the flashlight element in the first tube. Preferably, first tube 212, second tube 218, and retaining ring 216 are made of a metal material such as aluminum, and first tube 212 and retaining ring 216 are appropriately threaded so that retaining ring 216 may screw into first tube 212 to capture flashlight element 100 and force contact ring area 130 on the first side of flashlight element 100 against mating surface 224 in first tube 212, thereby establishing a high-conductivity thermal connection at the interface. A second high-conductivity thermal connection is also thereby established between retaining ring 216 and contact ring area 130 on the second side of flashlight element 100, so that heat may be conducted through retaining ring 216 and through the threaded interface between retaining ring 216 and first tube 212. Arrows 222 illustrate the path of heat flow from the flashlight element through these connections and into tubes 212 and 218, whereupon the heat may subsequently be radiated into the surrounding environment or into other elements connected with the flashlight.

In one alternative embodiment, retaining ring 216 and first tube 212 may not be threaded, and retaining ring 216 may be press-fit into first tube 212. In addition to the high-conductivity thermal interface between ring area 130 on the first side of flashlight element 100 and mating surface 224 in first tube 212, a second high-conductivity thermal connection is established between retaining ring 216 and contact ring area 130 on the second side of flashlight element 100, so that heat may be conducted through retaining ring 216 and through the press-fit junction between retaining ring 216 and first tube 212.

In another alternative embodiment, retaining ring 216 and first tube 212 may not be threaded, and retaining ring 216 may be press-fit into first tube 212. In addition to the high-conductivity thermal interface between ring area 130 on the first side of flashlight element 100 and mating surface 224 in first tube 212, a second high-conductivity thermal interface is established between the metal core of DSMCPCB 110 and the inside surface of first tube 212 through the outer periphery of the metal core that is in press-fit contact with tube 212.

In another alternative embodiment, retaining ring 216 may be further adapted with a central cavity configured to enclose and cover driver circuit 140 so as to hide the circuit from view. This configuration also serves to provide a backstop preventing battery 220 from contacting components within the driver circuit, thereby protecting driver circuit 140 in situations in which spring contact 150 is caused to be compressed beyond its normal range, such as occurs when the flashlight is subject to shock or vibration.

In another alternative embodiment, retaining ring 216 is not employed, and flashlight element 100 is retained directly by second tube 218. First tube 212 and second tube 218 are threaded on their mating surfaces such that second tube 218 screws into first tube 212 in the orientation shown in FIG. 2, thereby capturing flashlight element 100 and forcing contact ring area 130 on the first side of flashlight element 100 against mating surface 224 in first tube 212, and forcing the contact ring area 130 on the second side of flashlight element 100 against the end surface of tube 218, thereby establishing high-conductivity thermal connections at both interfaces.

In yet another alternative embodiment, retaining ring 216 is not employed, and DSCMPCB 110 may be press-fit into first tube 212. In addition to the high-conductivity thermal interface between ring area 130 on the first side of flashlight element 100 and mating surface 224 in first tube 212, a second high-conductivity thermal connection is thereby established between the edge of DSMCPCB 110 and first tube 212, so that heat may be conducted directly through the press-fit junction between the two elements.

In another embodiment, retaining ring 216 is made of a plastic material. In a further embodiment, retaining ring 216 is coated, for example in an anodization process, over at least a portion of its surface.

In each of the aforementioned embodiments, a paste or epoxy having high thermal conductivity, high electrical conductivity, or a combination of both, may be disposed at one or more of the interfaces between the flashlight element and tubes 212 and 218 to improve heat flow and ensure reliable electrical connection.

Most applications use MCPCBs in a manner that assumes that it will be mounted onto a heat sink, and thus heat will flow in a direction normal to the surface of the MCPCB. In the preferred embodiment of the present invention, the DSMCPCB makes ring contact between the MCPCB and a housing or other structure that may carry heat away from the flashlight element. Since both sides of the DSMCPCB contain heat-generating components, heat flow is thus radial from the typically centrally-located heat-generating elements, such as the light source and the drive circuit, out toward the edges of the flashlight element. MCPCBs may be constructed with arbitrary thickness, limited only by the availability of metal bar or sheet stock available for use as the central substrate. Thus, the DSMCPCB may be designed with such thickness as is necessary to support the required heat flow from the heat generating elements. From there, the heat may be conducted away from the flashlight element through either or both of the first and second surfaces, or through the edge of the flashlight element, provided that suitable contact is made with a heat sink or heat-conductive material. In certain applications, the thermal mass of the flashlight element itself may be sufficient to effectively cool heat-generating components, provided that the flashlight is operated, for example, substantially intermittently, and the flashlight element is allowed to cool through normal convection or radiation processes between periods of operation.

Figure 4:
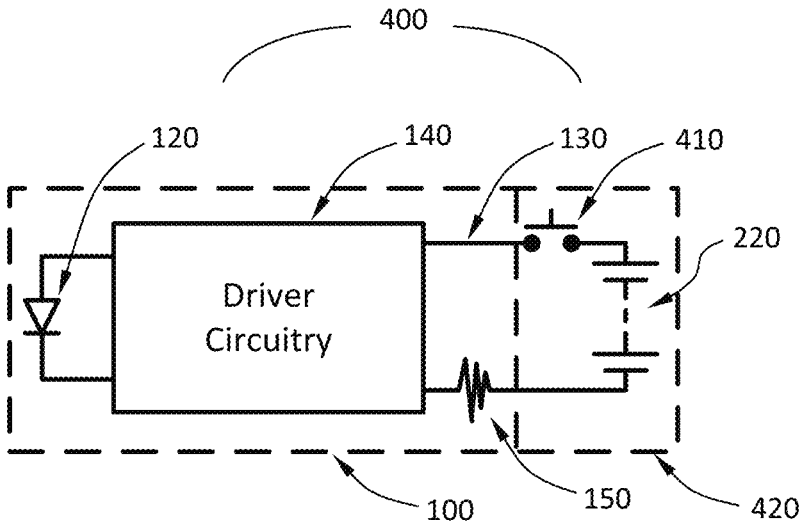
FIG. 4 is a schematic view of the flashlight element as integrated with batteries and switch in a complete and fully-functional flashlight design.

In a preferred embodiment of a flashlight 400 incorporating the flashlight element 100, shown schematically in FIG. 4, flashlight element 100 incorporates a constant current driver circuit 140, which drives LED 120. The remaining electrical function of the flashlight is represented by module 420, which contains two batteries 220 and a single-pole-single-throw switch 410 in series. Mechanically, switch 410 may be disposed at the end of battery tube 218, so that, in addition to housing the batteries, tube 218 serves as a conductor from the first battery contact on flashlight element 100 to the switch. The tube also serves as a heat sink for the system. Battery contact 150 is connected to the negative side of the battery stack, and battery contact 130 is connected to the first contact of switch 410. The positive side of the battery stack is connected to the second contact of switch 410, so that when the switch is closed, it completes the circuit between the battery stack and the flashlight element, and the driver begins delivering current to the LED.

The specific design topology for the driver circuit depends on various factors, including the number of LED sources and their connection arrangement, the specific characteristics of the LEDs employed in the design, and the number and type of batteries and their connection arrangement. If an alternate power source is used, the design will depend on the specific characteristics of the power supply. Drive circuit topologies include buck, boost, buck-boost, SEPIC, and flyback designs.

In a preferred embodiment, for example, two CR123 batteries are employed in series with approximately six volts at full charge, driving a single white-light LED with a voltage drop of approximately 3.5 volts. A buck regulator provides a constant drive current through the LED.

Figure 5:
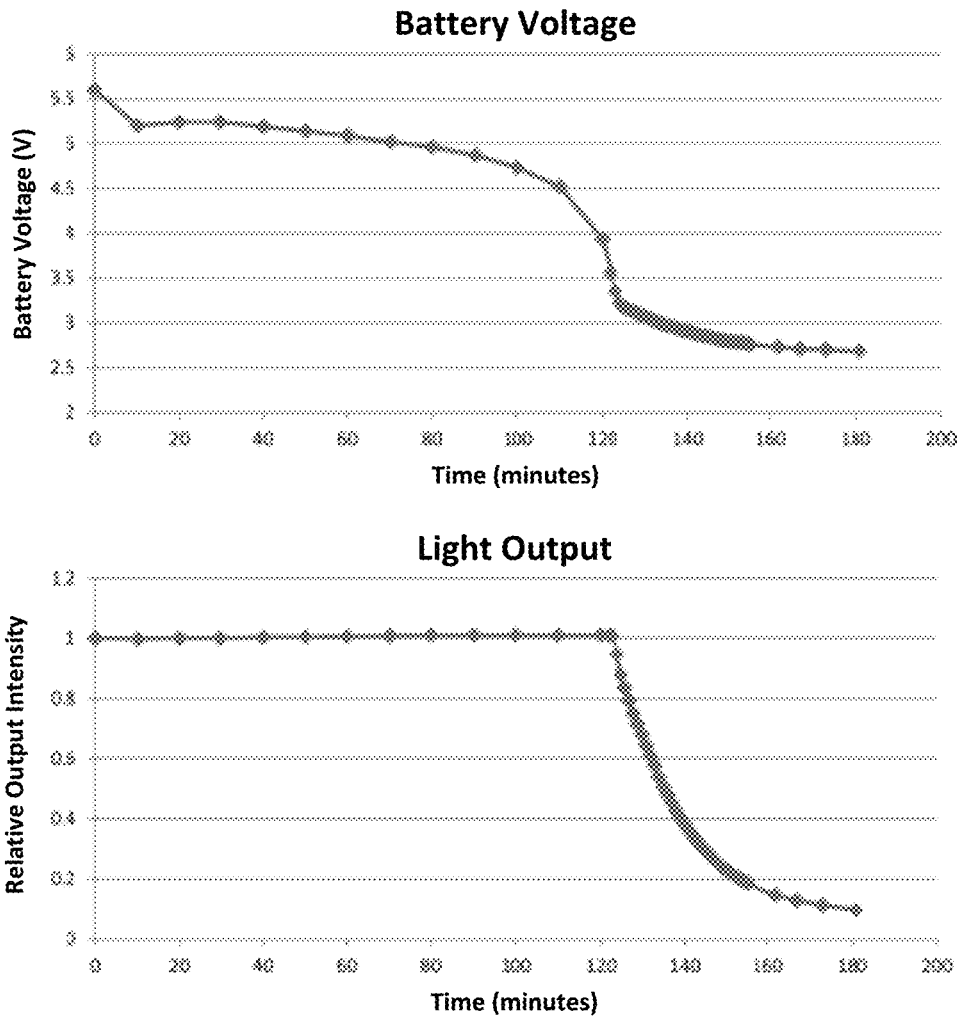
FIG. 5 shows total battery voltage and corresponding light output plots for continuous operation of the flashlight element with power supplied by two CR123 batteries in series.

FIG. 5 illustrates the performance of the flashlight for continuous operation over a period of approximately three hours. The upper graph shows the total battery voltage as a function of time, and the lower graph shows the corresponding light output from the flashlight. A benefit of using the buck regulator topology for the driver circuit is that it can maintain a constant current through the LED for a wide range of battery voltage, as long as the voltage remains above the voltage drop of the LED. This can be observed from the graphs, which show that the light output remains substantially constant for the first 120 minutes of operation, despite substantial changes in battery voltage. At that point, the total battery voltage drops below the voltage drop across the LED, approximately 3.5 volts, whereupon the driver circuit is no longer able to maintain the required current, and light output decreases until the battery is exhausted.

Because typical current regulators can operate over a range of input voltages while maintaining a constant current through the load, in this case, the LED light source, the present invention allows additional batteries to be added in series or parallel, up to the maximum input voltage of the drive circuit, to extend the useful operating time before the batteries are exhausted. Non-obvious is the fact that increasing the number of series-connected batteries by a factor of x results in more than x times the useful operating lifetime of the device on a fully-charged set of batteries due to changes in operating efficiency of typical switching current regulators over different input voltage regimes, as well as decreased losses in the batteries.

Figure 6:
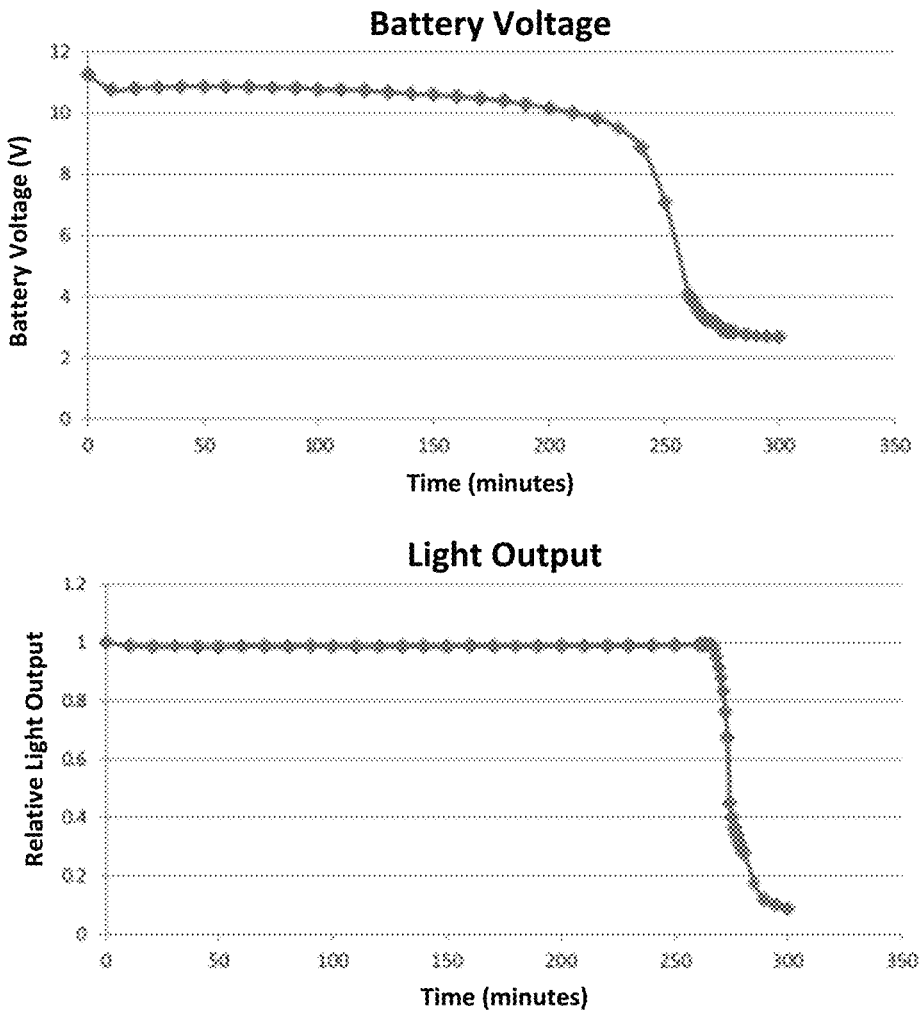
FIG. 6 shows total battery voltage and corresponding light output plots for continuous operation of the flashlight element with power supplied by four CR123 batteries in series.

For example, FIG. 6 illustrates the performance for the same flashlight element as in FIG. 5 powered with four CR123 batteries in series. As expected, the flashlight delivers constant light output for a much longer period of time, at which point, the total battery voltage again falls below the 3.5 volt drop of the LED. However, notable is the fact that the drop in light output occurs at approximately 4.5 hours, which is substantially more than double the 120 minutes achieved with two batteries.

Collocating both the LED light source and the drive circuitry on the same heat-conductive flashlight element substrate also enables the incorporation of one or more temperature sensors so that the drive circuit may be designed to adjust the current through the light source as a function of temperature. For example, the drive circuit may decrease the drive current through the LED when the temperature rises above a certain threshold value; or the drive circuit may increase or decrease the drive current to compensate for temperature-related changes in LED efficiency, thereby maintaining constant optical output power or intensity from the LED.

More advanced features may also be integrated into the flashlight element, as well. For example, the flashlight element could be designed to detect single-click, double-click and press-and-hold actuation patterns of the switch and cause the driver to operate in alternate modes, depending on which actuation pattern is detected. To accomplish this, a pattern-matching means could be incorporated into the driver to monitor the voltage supplied to the flashlight element. When it detects fluctuations across the battery contacts, it may try to match the pattern of fluctuations against a set of pattern templates, and if it finds a match, it may put the driver into a mode of operation corresponding to the pattern template that matches. For example, a single-click may indicate that the flashlight should subsequently operate in low-power mode, and a double-click may indicate that it should subsequently operate in high-power mode. Press-and-hold may cause the driver to turn on the LED in the last-indicated power mode. One possible pattern matching means could be a microcontroller programmed to time when the monitored voltage crosses a threshold. A pattern template could then be a set of timing windows in which the voltage is expected to cross the threshold for patterns matching that template.

It should be noted that though the present invention is described herein in the context of a battery-operated flashlight element designed for incorporation in a flashlight design, the same principles could be employed effectively on systems in many other application areas without deviating from the scope of the present invention.

What is claimed is:

1. A flashlight element, comprising:

a double-sided metal core printed circuit board having a first side and a second side;

at least one light emitting diode disposed on the first side;

a driver circuit disposed on at least one of said first and second sides and adapted to drive the light emitting diode;

a first battery contact disposed on at least one of said first and second sides;

a second battery contact disposed on the second side;

a light detector disposed on one of said first and second sides and adapted to detect at least a portion of the light emitted by the light emitting diode and to provide a light feedback signal;

a light control circuit disposed on at least one of said first and second sides, adapted to receive the light feedback signal and to control the driver circuit so as to maintain the light feedback signal at a predetermined value.

2. A flashlight element, comprising:

a double-sided metal core printed circuit board having a first side and a second side;

at least one light emitting diode disposed on the first side;

a driver circuit disposed on at least one of said first and second sides and adapted to drive the light emitting diode;

a first battery contact disposed on at least one of said first and second sides;

a second battery contact disposed on the second side;

temperature measurement means disposed on at least one of said first and second sides to provide a temperature feedback signal;

a temperature control circuit disposed on at least one of said first and second sides, adapted to receive the temperature feedback signal and control the laser driver circuit according to a predetermined function of temperature.

3. A flashlight element, comprising:

a double-sided metal core printed circuit board having a first side and a second side;

at least one light emitting diode disposed on the first side;

a driver circuit disposed on at least one of said first and second sides and adapted to drive the light emitting diode;

a first battery contact disposed on at least one of said first and second sides;

a second battery contact disposed on the second side;

pattern matching means adapted to:

detect a pattern of voltage fluctuation between the first and second battery contacts;

determine if the pattern of voltage fluctuation matches at least one predetermined voltage fluctuation pattern template; and control the driver circuit according to a predetermined mode of operation associated with the at least one predetermined voltage fluctuation pattern template.

* * * * *